US006494244B2

(12) United States Patent
Parrish et al.

(10) Patent No.: US 6,494,244 B2
(45) Date of Patent: Dec. 17, 2002

(54) TAPE TAB APPLICATOR

(75) Inventors: Timothy C. Parrish, Howards Grove, WI (US); Myron Free, Howards Grove, WI (US)

(73) Assignee: Curt G. Joa, Inc., Sheboygan Falls, WI (US)

( * ) Notice: Subject to any disclaimer, the term of this patent is extended or adjusted under 35 U.S.C. 154(b) by 0 days.

(21) Appl. No.: 09/998,464

(22) Filed: Oct. 31, 2001

(65) Prior Publication Data

US 2002/0038686 A1 Apr. 4, 2002

Related U.S. Application Data

(62) Division of application No. 09/521,736, filed on Mar. 9, 2000.

(51) Int. Cl.[7] ..... B32B 31/00

(52) U.S. Cl. ..... 156/519; 156/264; 156/265; 156/269; 156/270; 156/299; 156/300; 156/156; 156/302; 156/310; 156/552; 156/560; 156/522

(58) Field of Search ..... 156/264, 265, 156/269, 270, 299, 300, 310, 302, 519, 552, 560, 522

(56) References Cited

U.S. PATENT DOCUMENTS

| | | | | |
|---|---|---|---|---|
| 1,393,524 | A | 10/1921 | Grupe | 131/61.1 |
| 2,990,081 | A | 6/1961 | De Neui et al. | 156/519 |
| 3,772,120 | A | 11/1973 | Radzins | 156/264 |
| 3,960,646 | A | 6/1976 | Wiedamann | 156/518 |
| 4,171,239 | A | 10/1979 | Hirsch et al. | 156/461 |
| 4,701,239 | A | 10/1987 | Craig | 156/519 |
| 4,795,510 | A | 1/1989 | Wittock et al. | 156/64 |

*Primary Examiner*—Linda Gray
(74) *Attorney, Agent, or Firm*—Ryan Kromholz & Manion, S.C.

(57) ABSTRACT

This invention provides a method and apparatus for applying tape tabs to a traveling web, for example, for placement of fastening tabs on a running web of disposable diapers. The invention provides a cutting roll positioned to cut segments from a continuous infeeding web of tape material against a rotating anvil. The anvil, which is traveling at a speed equal to or very close to that of the infeeding tape web, carries the tape segments to a point on its tangency where a higher-speed traveling diaper web most nearly approaches, at which point the traveling diaper web is displaced slightly toward the anvil by means of a protuberance acting against the web. This movement causes it to come into contact with the next available tape segment, which becomes adhered to the higher-speed traveling web. This process provides for operation at higher speeds, higher efficiencies, greater flexibility and lower noise levels than previous processes.

6 Claims, 5 Drawing Sheets

PRIOR ART

TAPE TAB APPLICATOR

RELATED APPLICATION

This application is a divisional for co-pending U.S. patent application Ser. No. 09/521,736, filed Mar. 9, 2000, pending.

BACKGROUND OF THE INVENTION

The present invention relates to processes and apparatus for applying tabs to traveling webs. The invention has particular applicability to the manufacture of disposable diapers.

The history of cutting and applying tape tabs to disposable diaper webs is now entering its fourth decade. Over the course of that time, various types of automatic manufacturing equipment have been developed which produce the desired results with a variety of materials and configurations. This equipment generally included window-knife and slip-and-cut applicators, each having their own advantages and limitations.

Window-knife applicators are comprised of: one or more rotating heads, each made up of a knife edge and a vacuum plate; a more or less stationary knife, which is configured with a hole (window); and a tape transfer mechanism. Typically, the rotating heads are mechanically configured so as to eliminate head rotation relative to the stationary knife. Each head is passed, once per cycle, across the face of the stationary window knife, through which the infeeding tape is passed. The rotating knife shears the extended length of tape against the sharp inner edge of the hole (window), after which the severed segment is held by the vacuum plate. The rotating head, with the segment of tape held in place by the vacuum plate, continues through its rotation to a point, usually 90 degrees later, where it contacts the traveling web, which is pressed against the exposed adhesive of the tape segment. This contact, usually against some backing device, effects a transfer of the tape tab from the vacuum plate to the traveling web, which then carries the tape tab downstream.

Window-knife applicators have a few shortcomings, among which are: the difficulty in feeding tape webs with little axial stiffness; the tendency of the infeeding tape to adhere to the window knife-edge; and for exposed adhesive to contaminate the surfaces of the window knife. For effective cutting, some degree of interference between the cutting edges is necessary between the moving and stationary knife faces, so to minimize impact, precision in manufacturing must be maintained and provision must be made for a degree of resiliency. While applicators of this type have been tested to speeds of 1000 cuts per minute, the maximum practical speed capability of current designs is approximately 750 cuts per minute.

Slip-and-cut applicators are typically comprised of (a) a cylindrical rotating vacuum anvil (b) a rotating knife roll and (c) a transfer device. In typical applications, a tape web is fed at a relatively low speed along the vacuum face of the rotating anvil, which is moving at a relatively higher surface speed and upon which the tape web is allowed to "slip". A knife-edge, mounted on the rotating knife roll, cuts a segment of tape from the tape web against the anvil face. This knife-edge is preferably moving at a surface velocity similar to that of the anvil's circumference. Once cut, the tape tab is held by vacuum drawn through holes on the anvil's face as it is carried at the anvil's speed downstream to the transfer point where the tape segment is transferred to the traveling web.

A common problem with slip-and-cut applicators lies in the tendency to accumulate various contaminants on their anvil surfaces. This is most frequently seen in the form of the release compounds found on the non-adhesive side of tape, which is shipped on pre-wound rolls. Where die-cut tapes are fed onto the surfaces of slip-and-cut applicators, it is common to also see an accumulation of adhesive contamination, as the adhesive has been exposed at the tape edges by the die-cutting process. The difference in speed between the tape web and the anvil tends to "wipe" adhesive from the tape web. Contamination of the anvil, whether by release compounds or by fugitive adhesive, interferes with the regularity of slip occurring between the tape and the anvil, causing registration and cut accuracy problems. Frequent cleaning is necessary to maintain any level of productivity.

Another problem associated with slip-and-cut applicators occurs at the point of cut. Since the web being cut is traveling at a very low velocity compared to the anvil and knife velocity (perhaps $1/20^{th}$), the engagement of the knife with the tape web tends to induce a high tensile strain in the tape web. Having been placed under such a high level of stress, the tape web can recoil violently when the cut is finally completed, causing loss of control of the tape web. This "snap-back" effect increases with the thickness of the tape web. Thicker webs tend to prolong the duration of engagement with the knife before completion of the cut, thereby increasing the build-up of strain. This is a common process problem that is usually addressed by the provision of various shock-absorbing devices. One possible solution might have been to reduce the surface velocity of the knife, but substantially different velocities between the knife and anvil result in rapid wear of the knife edge and/or anvil face, depending on relative hardness.

Continual improvements and competitive pressures have incrementally increased the operational speeds of disposable diaper converters. As speeds increased, the mechanical integrity and operational capabilities of the applicators had to be improved accordingly. As a further complication, the complexity of the tape tabs being attached has also increased. Consumer product manufacturers are offering tapes which are die-cut to complex profiles and which may be constructed of materials incompatible with existing applicators. For instance, a proposed tape tab may be a die-profiled elastic textile, instead of a typical straight-cut stiff-paper and plastic type used in the past. Consequently, a manufacturer may find itself with a window-knife applicator, which cannot feed a tape web with too little axial stiffness. It could also find itself with a slip-and-cut applicator, which cannot successfully apply die-cut tape segments. Furthermore, existing applicators cannot successfully apply tapes whose boundaries are fully profiled, as may be desired to eliminate sharp corners, which might irritate a baby's delicate skin. This demonstrates a clear need for an improved applicator capable of applying new tape configurations and overcoming other shortcomings of prior art applicators.

SUMMARY OF THE INVENTION

A basic premise of all applicators using prior art has been to cut the tape at one velocity and then to carry it at its final velocity to the transfer point. The assumption has been made that for correct and accurate placement, the tape tab must be moving at the final web velocity. The proposed invention diverges from that premise, eliminating or reducing the shortcomings associated with prior devices.

In accordance with an important aspect of the invention tape segments are cut and carried at a very low tape web infeed speed. In accordance with a related aspect, problems with transferring a slow-moving segment to a fast-moving web are overcome. Additionally, die-cutting of tape segments to any number of practical shapes is possible, thereby avoiding difficulties associated with prior attempts to do so using previous applicator technology, which required multiple steps to accomplish the same task.

The invention provides the additional benefit of quiet operation compared to prior art equipment, which uses high speed cutting faces and suffers from the effects of the very high energy levels seen at the point of contact. Generally, these energies, and the sounds that they generate, increase in proportion to the square of the velocity. The present invention benefits from the relatively low speed of the cutting faces and exhibits extremely low noise levels. In fact, the underlying noise of the mechanical drive systems and the traveling web equipment contribute to make the cutting noise level nearly unnoticeable.

The present invention provides a simplified process wherein a rotary knife or die, with one or more cutting edges, turns against and in coordination with a corresponding vacuum anvil cylinder. An infeeding tape web is fed along the surface of the anvil, which is rotating at a surface velocity equal to or only somewhat greater than that of the tape web. As the tape web passes the nip created between the knife-edges and the anvil surface, segments of tape are parted but not significantly displaced upon the anvil surface. The segments continue downstream on the anvil surface, held securely by forces induced by a vacuum source directed to one or more holes provided for each segment in the anvil surface.

At a point downstream along the surface of the anvil, the traveling web to which the segments are to be attached is brought into close proximity with the anvil and its tape segments. A mechanically operated device, which may be as simple as a protuberance on a rotating cylinder, presses the target zone of the traveling web against the exposed adhesive of the tape segment as it is presented on the anvil surface. The protuberance preferably has a surface velocity substantially identical to that of the traveling web. Given the extremely low moment of inertia of the tape segment and the aggressive adhesion provided between its exposed adhesive and the compatible surface of the traveling web, each successive segment is successfully transferred to the traveling web, accelerating almost instantly to the speed of the traveling web.

A key aspect of this invention lies in the method and apparatus used to effect the transfer of the tape segments from the anvil to the traveling web. In accordance with the invention, a vacuum commutation system is configured to remove or reduce the level of vacuum used to hold each tape segment to the anvil surface just before the point of transfer. The materials and finishes selected for the anvil and the transfer protuberance provide a situation in which the coefficient of friction between the protuberance and the traveling web is relatively high, while the coefficient of friction between the tape segment and the anvil is relatively low. The highly aggressive nature of the bond between the adhesive side of the tape segment and the target surface of the traveling web ensures that there is virtually no slippage between the two. This ensures that the traveling web is driven through the point of transfer at its existing velocity, and that any tendency of the tape segment to adhere to the anvil surface will not influence the traveling web. The process requires that some slip occurs, and in accordance with the invention, slip occurs only between the tape segment and the anvil surface.

This method is extremely effective in that 25 mm tape segments can be accurately transferred at 800 mm spacing to webs traveling at 300 meters per minute or more. This is a web-to-tape velocity ratio of 32:1. Tape to tape positional accuracy has been found to be extremely precise, with standard deviations of less than 1 mm when applied at a 800 mm spacing. Additionally, a speed capability of more than 2,400 tapes per minute is achievable, easily exceeding the limits of any previously known disposable paper product manufacturing process.

Further objects and advantages of the invention will be apparent from the following detailed description, the attached claims and the drawings.

DETAILED DESCRIPTION OF THE INVENTION

Figure 1:
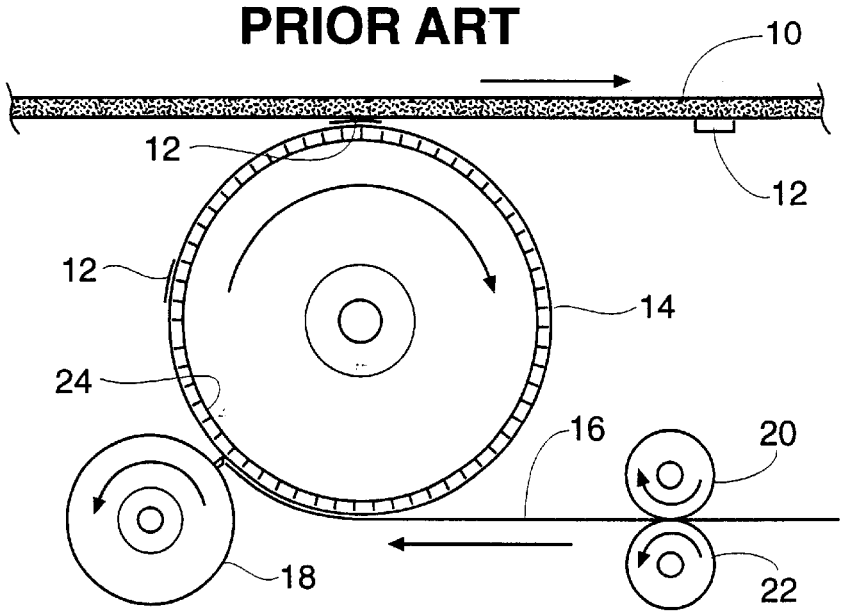
FIG. 1 is a diagrammatic side view of a Prior Art process.

Referring more particularly to the drawings there is seen in FIG. 1 a diagrammatic illustration of a prior art process for applying tabs to webs in a diaper making process. Web 10 is a composite material used in formation of diapers which is generally formed of various layers of material such as plastic back sheets, absorbent pads and nonwoven topsheets. A series of tape segments 12 are applied to web 10. In the illustrated process a rotatable vacuum anvil 14 is used to supply the tabs 12 which have an outwardly facing adhesive coated surface used to adhere the tabs 12 to web 10. Anvil 14 has internally reduced air pressure or vacuum, and a plurality of openings 24 are provided through its surface to enable suction of the tabs segments 12 against the anvil surface 14. A web of the tape tab forming material 16 is fed by rollers 20 and 22 against the anvil surface 14 where it is cut into segments by a rotary knife 18.

In this prior art application the anvil 14 is rotated at a speed such that its outer perimeter, and thus the tabs 12 carried thereby, are moving at a speed approximately equal to that of web 10. This causes a great deal of slippage to occur between the anvil 14 and the lower speed infeeding web 16.

Figure 2:
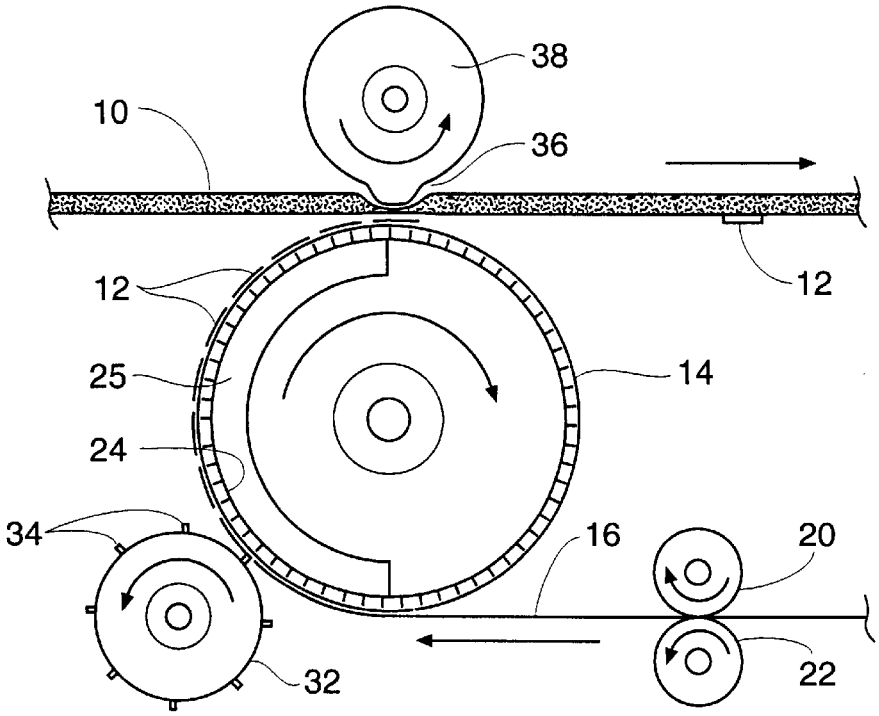
FIG. 2 is a diagrammatic side view illustrating a preferred process of this invention.

Referring to FIG. 2, the apparatus and process of this invention is shown in diagrammatic fashion. In accordance with the invention, the web 16 is fed to the anvil 24 at a speed such that the web speed of web 16 approximately equals the speed at which the outer periphery of anvil 14 is traveling. If desired, the anvil 14 may rotate at a slightly higher speed than the linear speed of the web 16. The blades 34 of a rotary cutter 32 are also traveling at a peripheral speed equal to that of anvil 14. As seen in FIG. 2, after cutting, a series of tabs 12 are carried on the outer surface of anvil 14. Tabs 12 are held in place by vacuum provided within the interior of anvil 14. The adhesive-coated surface of web 16 is facing outwardly while a non-tacky or uncoated surface engages the exterior anvil 14.

A web 10 of diaper material is caused to travel in a path slightly displaced from the outer surface of rotating anvil 14, but in close proximity thereto. Just above the web 10 is a rotating wheel 38, which rotates at a peripheral velocity equal to the lineal velocity of web 10, which, in turn, is substantially greater than the peripheral velocity of anvil 14. In practice, to realize the benefits of this invention, the peripheral velocity of anvil 14 should not be greater than about 5 times the velocity of web 10.

Wheel 38, as seen in FIG. 2, has a protrusion 36 which extends along its width. The rotational speed of roller 38 is selected so that the protrusion 36 engages web 10 and displaces it into contact with each successive adhesive-coated tab 12. The slight displacement of web 10 causes it to come into contact with the tab segment 12 which, then, is instantly adhered to the higher speed traveling web 10. The coefficient of friction between the uncoated side of tab 12 and the metal surface of anvil 14 is low so that the aggressive adhesion between tab 12 and web 10 together with the extremely low moment of inertia of tape tab segment 12 facilitates successful transfer of the tabs 12 to the web 10, the tabs 12 accelerating almost instantly to the higher speed of web 10.

To further facilitate the transfer of tabs 12 to web 10, a vacuum commutation is provided to remove or substantially reduce the level of vacuum used to hold tape segments 12 to the anvil surface 14 just before the point of transfer. For this purpose, an interior arcuate plenum 25 is situated within anvil 14 in order to provide vacuum only along the portion of anvil 14 which engages web 16 up to a location just short of the transfer point. Thus, the portion of the anvil 14 which does not engage web 16 or tabs 12 is not provided with vacuum.

While the drawings show the protrusions 36 on cylinder 38 in somewhat exaggerated form, in practice the protrusions 36 can simply be in the form of a lobe on the cylindrical surface as low as 0.030 inch in height, but may, if desired, be of a much greater height.

Figure 3:
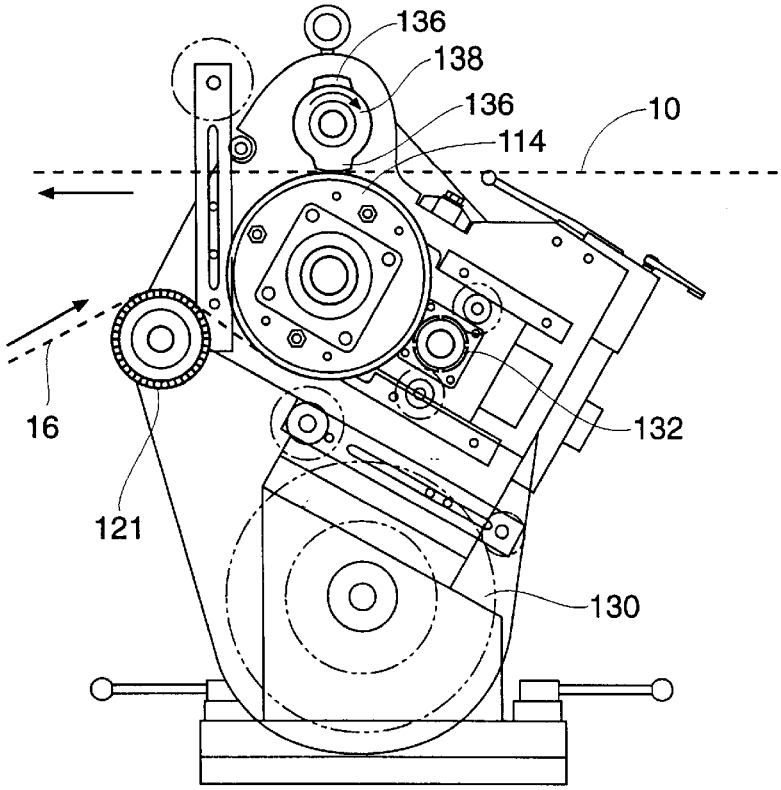
FIG. 3 is a side view illustrating a further embodiment of the invention.
Figure 4:
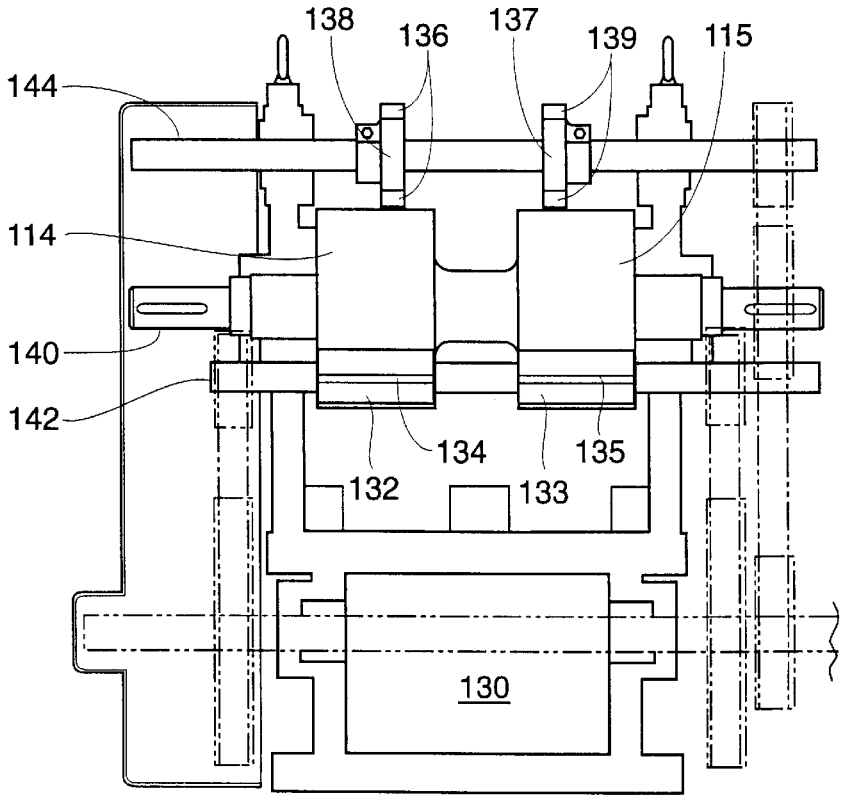
FIG. 4 is a front elevational view of the equipment of FIG. 3 viewed from the right hand side of FIG. 3.

Referring to FIGS. 3 and 4, there is seen an arrangement of the apparatus of this invention generally more suited for commercial operation. As viewed in FIG. 3, web 10 is travelling to the left and adhesive-backed tape 16 is fed over a roller 121 onto anvil/drum 114. Tape web 16 is cut into individual tape tabs by a rotary cutter 132. As the tape tab segments 12 travel to the top of drum 114 as viewed in FIG. 3, the web 10 is intermittently impacted by lobes 136 located on opposite sides of rotatable wheel 138. The apparatus is driven by a motor or power supply 130 through various mechanical drive connections generally shown by dotted or phantom lines in FIG. 4.

As viewed in FIG. 4, a second laterally displaced anvil 115 receives another tape web 16 which is cut into tab segments 12 by blades 135 on a rotary cutter 133. A pair of lobes or protrusions 139 on a rotatable wheel 137 cause the web 10 to pick up each successive tab segment 12 from the anvil 115 just as in the case of the other anvil 114. In this manner, tape tabs 12 are applied to each lateral edge of a web which is subsequently formed into a diaper product. These tape tabs 12 may have ends provided with hook and loop fasteners or other fastening means selected for use in connection with the diaper product.

Also, as seen in FIG. 4, the rotatable anvils 114 and 115 are rotatably driven by a shaft 140. Similarly, rotary cutters 132 and 133 are mounted on another shaft 142 while the rotatable disks 138 and 137 are mounted on another shaft 144.

Figure 5:
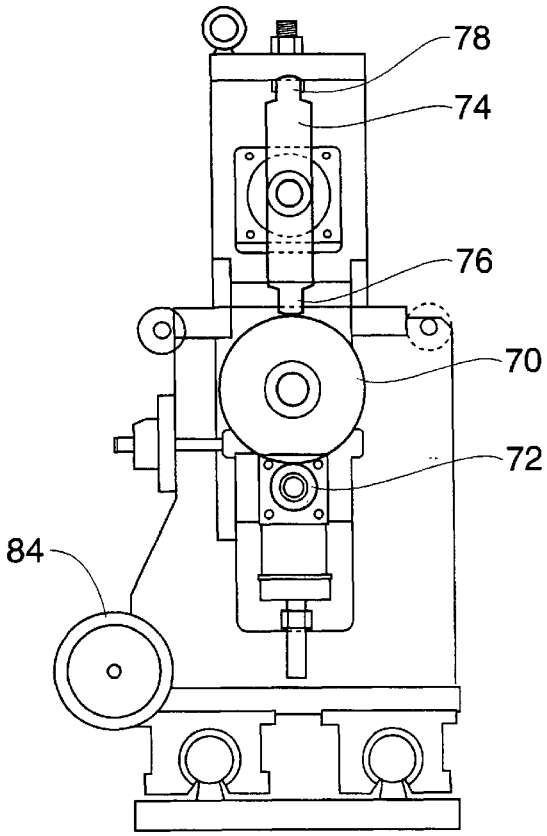
FIG. 5 is a side elevational view of yet another embodiment of the invention.
Figure 6:
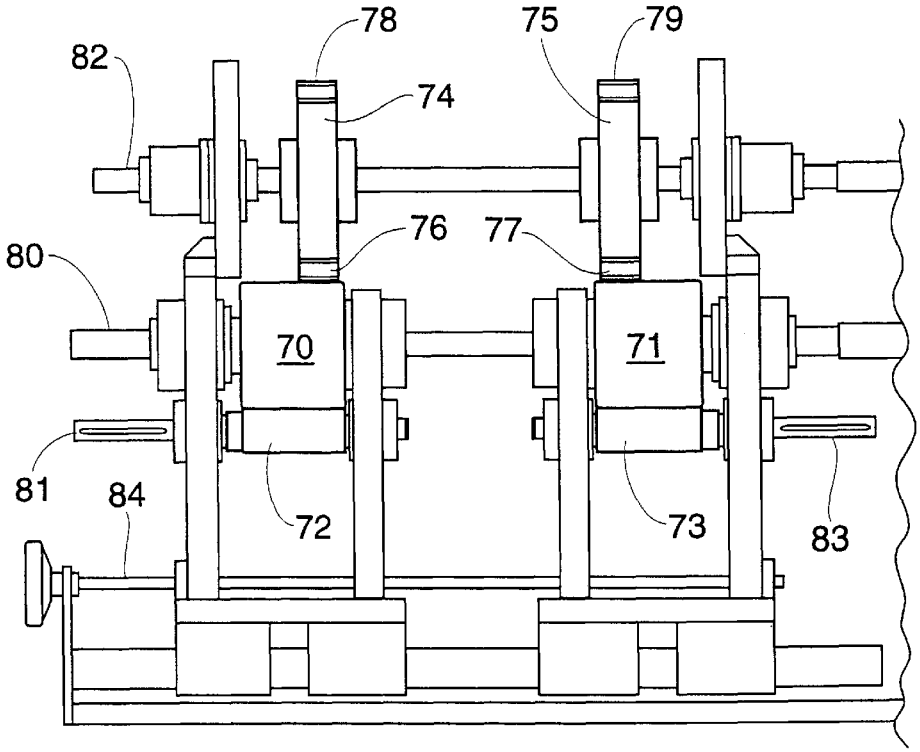
FIG. 6 is a front elevational view of the apparatus shown in FIG. 5 as viewed from the right hand side of FIG. 5.

In FIGS. 5 and 6 there is seen still another embodiment of the invention particularly suited to manufacture of baby diapers having tape tabs thereon. In this case the rotatable anvil 70, as viewed in FIG. 5, is similar to anvil 14 previously described in detail. A rotary cutter 72 is provided with cutting blades just as in the case of cutter 32. In this embodiment a rotatable bar 74 is provided with ends 76 and 78 that serve to push a traveling web against a succession of tabs 12 carried by the anvil 70. In other respects the apparatus and operation of the device shown in FIGS. 5 and 6 is similar to that previously described. As seen in FIG. 6 a second anvil 71 is engaged by a second rotary cutter 73 to cut a second series of tabs for the lateral side of the diapers opposite that engaged by anvil 70. A second rotary bar 75 is provided with lobes 77 and 79 which serve in the same fashion as lobes 76 and 78 of rotary bar 74. Also as seen, the anvils 70 and 71 are rotatably mounted on a shaft 80 and rotatable bars 74 and 75 are rotatably mounted on a shaft 82 while cutters 72 and 73 are mounted on shafts 81 and 83, respectively. All of these devices may be driven, as shown, by a supply of power from a rotating shaft 84 driven by a power supply common to other components of the production line. The arrangement of drive belts, etc., as shown for purposes of illustration, but does not form a part of the invention, since such components of the production line would routinely be designed by engineers skilled in the art.

Figure 7:
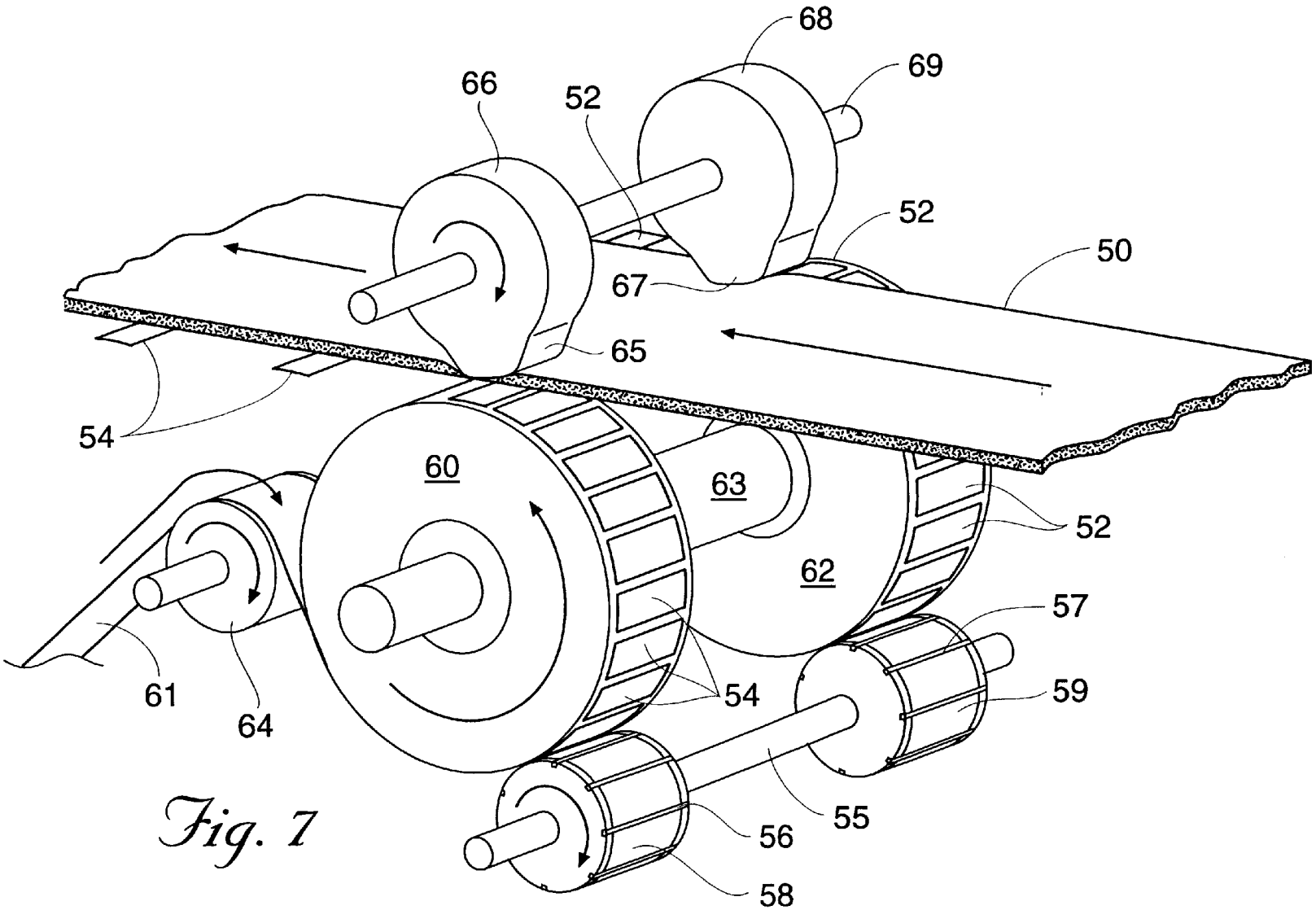
FIG. 7 is a perspective view in somewhat diagrammatic form illustrating a further embodiment of the invention; and, FIG. 8 is a diagrammatic side elevational view illustrating yet another embodiment of the invention.

In FIG. 7 there is shown, for purposes of clarity, a simplified device in accordance with the invention, illustrating the application of tabs 52 and 54 which have free ends extending laterally from opposite sides of a diaper-forming web 50. These free ends of tabs 52 and 54 may be provided with loops on one side of the diaper-forming material and hooks on the opposite side to form hook and loop fasteners on the diapers commonly referred to as Velcro®. In other cases, the tabs on at least one side may be coated with a pressure sensitive adhesive protected until use by a release layer As further seen in FIG. 7, an adhesive-coated tape web 61 is fed over a roller 64 onto an anvil 60 similar to anvil 14 previously described. A similar anvil 62 engages a second adhesive-coated web. These webs may have adhesive coated on one-half of their width and a hook or loop-type fastener provided on the opposite half of the width in order to form the laterally extending tabs 52 and 54. These webs are cut by blades 56 of rotary cutters 58 and blades 57 of a second rotary cutter 59, respectively. As seen, both of the cutters 58 and 59 are driven by a rotatable shaft 55. Similarly, anvils 60 and 62 are driven by a central shaft 63. Rotatable disks 66 and 68 provided with protrusions 65 and 67 serve to deflect the edges of the web 50 toward the respective anvils 60 and 62 in order to simultaneously pick up the tabs 54 and 52 on opposite sides of the web 50, as shown.

Figure 8:
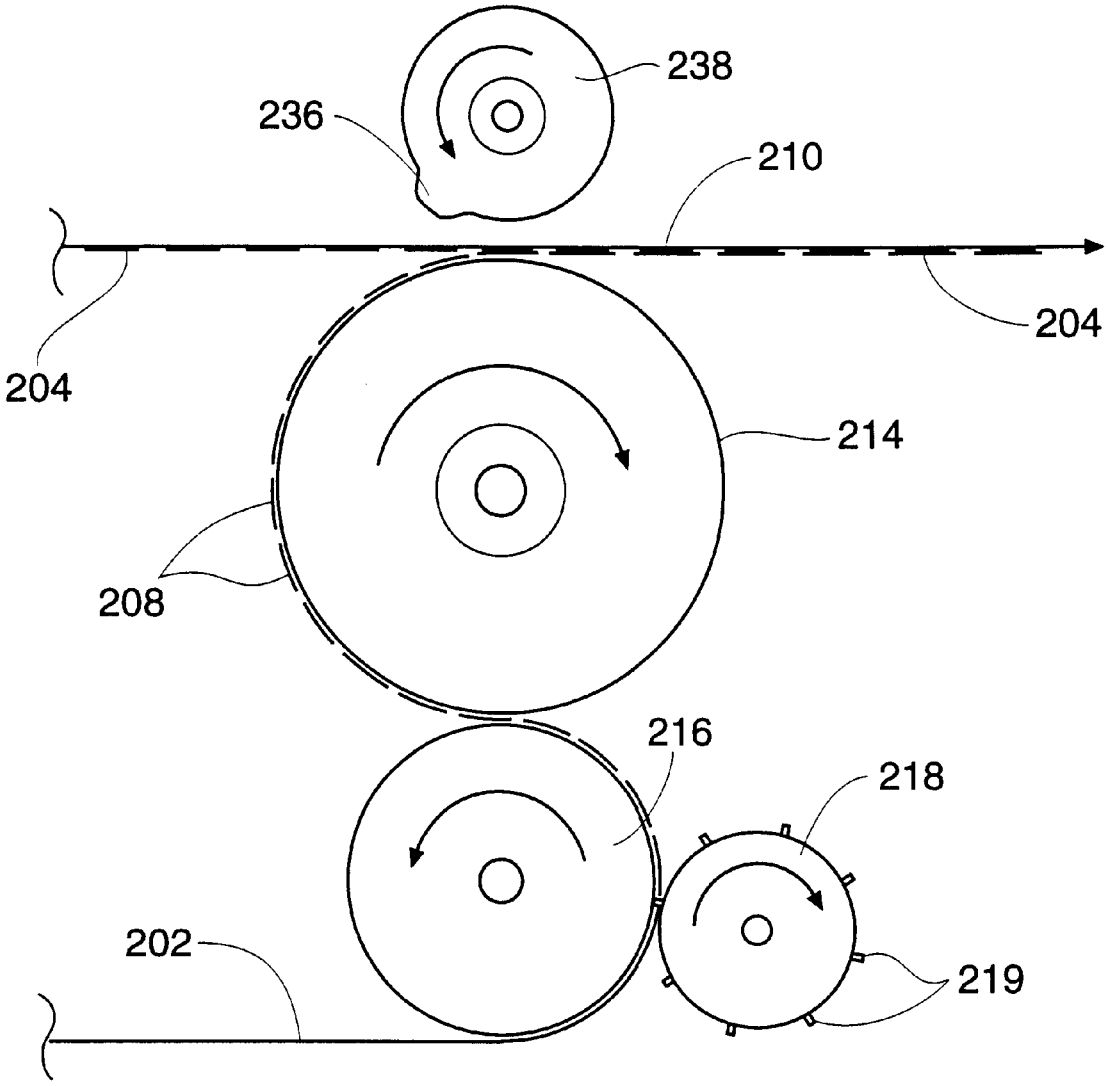

A still further alternative embodiment of the invention is illustrated in FIG. 8. In this embodiment, a diaper-forming web 210 is intermittently coated with adhesive deposits 204 along the edge of the web 210. A tab-forming web 202 is fed over a hollow vacuum anvil 216 and cut there against into a series of tabs 208 by blades 219 of a rotary cutter 218. An intermediate transfer roll 214 also provided with internal vacuum is used to transport the tabs 208 into close proximity with the bottom of web 210. Again, a traveling drum 238 having lobes 236 is traveling at a speed such that a lobe 236 contacts the web 210 just as an adhesive-coated area 204 is aligned with one of the tabs 208. Displacement caused by action of the lobe 236 against the web 210 causes the each tab 208 to become adhered to one of the adhesive coated areas 204. In other respects the operation of the device of FIG. 8 is similar to that previously heretofore described.

The foregoing descriptions are set forth for illustrative purposes rather than by way of limitation, since it will be apparent to those skilled in the art that various additional embodiments exemplifying the principles of the invention may be devised.

What is claimed is:

1. Apparatus for applying segments of tape to a traveling web comprising a cylindrical anvil roll with a pattern of vacuum openings on a peripheral surface thereof and means for drawing a vacuum within said cylindrical anvil, means for feeding a continuous web of adhesive-backed tape onto said anvil, with said adhesive facing outwardly relative to said anvil's center, a knife roll, positioned to cut said web of tape against said anvil, creating a continuous stream of segments of said tape on the face of said anvil, means for transporting a traveling web positioned in close proximity to, but not in contact with said anvil, means for intermittently displacing a selected portion of said traveling web into contact with said outwardly facing adhesive surface of each successive one of said tape segments carried by said anvil wherein said means for displacing said selected portion of traveling web is a rotating member.

2. Apparatus for applying segments of tape to a traveling web comprising a cylindrical roll with a pattern of vacuum openings through a peripheral surface thereof, means for drawing a vacuum within said cylindrical roll, means for successively feeding a stream of adhesive backed tabs on said roll, with said adhesive facing outwardly relative to said roll's center, means for transporting a traveling web positioned in close proximity to said roll, a protuberance on a rotatable cylinder for pressing a selected portion of said traveling web against said outwardly-facing adhesive of said tabs whereby each of said tabs as successively adhered to said traveling web.

3. Apparatus according to claim 1 wherein said knife roll comprises a rotary die.

4. Apparatus according to claim 2 wherein said roll comprises a transfer roll and said apparatus further comprises a hollow anvil, and a rotary die for cutting said segments from a web of material fed onto said anvil, said anvil being adapted to feed said tabs onto said transfer roll.

5. Apparatus for applying segments of tape to a traveling web comprising a cylindrical anvil roll with a pattern of vacuum openings on a peripheral surface thereof and means for drawing a vacuum within said cylindrical anvil, means for feeding a continuous web of adhesive-backed tape onto said anvil, with said adhesive facing outwardly relative to said anvil's center, a knife roll, positioned to cut said web of tape against said anvil, creating a continuous stream of segments of said tape on the face of said anvil, means for transporting a traveling web positioned in close proximity to, but not in contact with said anvil, means for intermittently displacing a selected portion of said traveling web into contact with said outwardly facing adhesive surface of each successive one of said tape segments carried by said anvil wherein said means for displacing said selected portion of traveling web comprises a protuberance on a rotatable cylinder.

6. Apparatus for applying segments of tape to a traveling web comprising a cylindrical anvil roll with a pattern of vacuum openings on a peripheral surface thereof and means for drawing a vacuum within said cylindrical anvil, means for feeding a continuous web of adhesive-backed tape onto said anvil, with said adhesive facing outwardly relative to said anvil's center, a knife roll, positioned to cut said web of tape against said anvil, creating a continuous stream of segments of said tape on the face of said anvil, means for transporting a traveling web positioned in close proximity to, but not in contact with said anvil, means for intermittently displacing a selected portion of said traveling web into contact with said outwardly facing adhesive surface of each successive one of said tape segments carried by said anvil wherein said means for displacing said selected portion of traveling web comprises a driven contact component which is traveling at a speed substantially equal to the speed of said traveling web.

* * * * *